US008524376B2

(12) United States Patent
Hatano

(10) Patent No.: US 8,524,376 B2
(45) Date of Patent: Sep. 3, 2013

(54) HEAT-RESISTANT SN-PLATED CU-ZN ALLOY STRIP WITH SUPPRESSED WHISKERING

(75) Inventor: Takaaki Hatano, Koza-gun (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 1299 days.

(21) Appl. No.: 12/226,631

(22) PCT Filed: Apr. 26, 2007

(86) PCT No.: PCT/JP2007/059080

§ 371 (c)(1),
(2), (4) Date: Oct. 23, 2008

(87) PCT Pub. No.: WO2007/126010

PCT Pub. Date: Nov. 8, 2007

(65) Prior Publication Data

US 2009/0092851 A1 Apr. 9, 2009

(30) Foreign Application Priority Data

Apr. 26, 2006 (JP) ..... 2006-121836

(51) Int. Cl.
*H01R 13/03* (2006.01)
*C25D 5/50* (2006.01)
*B32B 5/20* (2006.01)

(52) U.S. Cl.
USPC ..... 428/647; 428/648; 428/610; 428/675; 428/929; 439/886; 439/887; 200/266; 200/269; 148/518; 148/536; 148/537; 205/226

(58) Field of Classification Search
None
See application file for complete search history.

(56) References Cited

U.S. PATENT DOCUMENTS 6,136,460 A * 10/2000 Chen et al. ..... 428/699
6,183,886 B1 * 2/2001 Chen et al. ..... 428/647

(Continued)

FOREIGN PATENT DOCUMENTS

JP 04-329891 * 11/1992
JP 06-0196349 7/1994
JP 2002-317295 10/2002
JP 2003-293187 10/2003

(Continued)

OTHER PUBLICATIONS

Davis, Joseph R.; "Copper and Copper Alloys"; ASM International; 2001; p. 325, 326, 328, 329.*

(Continued)

*Primary Examiner* — John J Zimmerman
(74) *Attorney, Agent, or Firm* — Drinker Biddle & Reath LLP

(57) ABSTRACT

In an Sn-plated strip in which a copper alloy containing 15 to 40 mass % of Zn in terms of an average concentration is used as an alloy strip and the layers of an Sn phase, an Sn—Cu alloy phase and an Ni phase constitute a plating film from the surface to the alloy strip, the Zn concentration of the surface of the Sn phase is adjusted to a range of 0.1 to 5.0 mass %. The alloy may further contain 0.005 to 3.0 mass % in total of an arbitrary constituent selected from Sn, Ag, Pb, Fe, Ni, Mn, Si, Al and Ti. Moreover, the alloy may be a copper base alloy containing 15 to 40 mass % of Zn, 8 to 20 mass % of Ni, 0 to 0.5 mass % of Mn and a balance of Cu and unavoidable impurities, and may further contain 0.005 to 10 mass % in total of the above arbitrary constituent. There is provided a Cu/Ni double layer base reflowed Sn-plated Cu—Zn alloy strip in which generation of whiskers is suppressed.

6 Claims, 2 Drawing Sheets

(56) References Cited

U.S. PATENT DOCUMENTS

| | | | | |
|---|---|---|---|---|
| 6,939,621 | B2 * | 9/2005 | Hara et al. | 428/647 |
| 7,972,709 | B2 * | 7/2011 | Hatano | 428/647 |
| 8,182,932 | B2 * | 5/2012 | Hatano | 428/647 |
| 2005/0025990 | A1 * | 2/2005 | Laurello et al. | 428/610 |

FOREIGN PATENT DOCUMENTS

| | | | |
|---|---|---|---|
| JP | 2004-068026 | | 3/2004 |
| JP | 2005-350774 | | 12/2005 |
| WO | WO 2007/004581 | * | 1/2007 |

OTHER PUBLICATIONS

Copper Development Association; "The Nickel Silvers"; Pub 71; 1965.*

Copper Development Association; "The Brasses—Properties & Applications—Section 7 Brasses—Corrosion Resistance"; Pub 117; 2005.*

Shanghai Metal Corporation; "Product Specifications of Brass Strip and Sheet"; Jun. 2006; Downloaded from www.shanghaimetal.com.*

* cited by examiner

HEAT-RESISTANT SN-PLATED CU-ZN ALLOY STRIP WITH SUPPRESSED WHISKERING

TECHNICAL FIELD

The present invention relates to a heat-resistant Sn-plated Cu—Zn alloy strip in which generation of whiskers is suppressed.

BACKGROUND ART

A Cu—Zn based alloy has poor spring properties as compared with phosphor bronze, beryllium copper, Corson alloy or the like, but the alloy is inexpensive, and hence it is broadly used as an electric contact material for a connector, a terminal, a relay, a switch and the like. A typical example of the Cu—Zn based alloy is brass, and an alloy such as C2600 or C2680 is defined in JIS H3100. When the Cu—Zn based alloy is used as an electric contact material, the alloy is often plated with Sn so as to stably obtain low contact resistance. A large amount of Sn-plated Cu—Zn based alloy strips is used in electric and electronic components such as terminals of wire harness for car electric equipment, terminals of printed circuit boards (PCB) and connector contacts for households, because Sn is excellent in solderability, corrosion resistance and electric connection properties.

The Sn-plated Cu—Zn based alloy strip is manufactured by steps of forming a base plating layer by an electric plating process after degreasing and pickling, then forming an Sn plating layer by the electric plating process, and finally performing a reflow treatment to melt the Sn plating layer.

To plate the Cu—Zn based alloy with Sn, the alloy is usually subjected to base plating prior to the Sn plating. This is because if the alloy is not subjected to the base plating, Zn in an Cu—Zn alloy strip forms a Zn concentrated layer on the Sn-plated surface during the reflow treatment, and the solderability deteriorates. That is, the base plating is performed in order to obtain an underlayer in which the diffusion of Zn of the alloy strip in the Sn-plated surface is suppressed.

In order to improve the heat resistance of the Sn plating, the Cu—Zn based alloy is subjected to Cu/Ni double layer base plating as the base plating. In the above Cu/Ni double layer base plating, electric plating including Ni base plating, Cu base plating and Sn plating are performed in this order, followed by the reflow treatment. A plating film layer after the reflow has a constitution in which an Sn phase, a Cu—Sn phase and an Ni phase are deposited on the alloy strip in this order from the surface. Details of this technique are disclosed in Patent Documents 1 to 3 (JP6-196349A, JP2003-293187A, JP2004-68026A) and the like.

It is known that when an Sn-plated strip is left to stand at room temperature, single crystals of Sn grow from the Sn-plated surface. The single crystals of Sn are referred to as whiskers, which sometimes cause the short-circuit of the electronic components. The whiskers are generated owing to the internal stress of the Sn-plated film formed by electrodeposition. Therefore, the reflow treatment for melting Sn to remove the internal stress of the film is effective as means for suppressing generation of whiskers. In the manufacturing process of a Cu/Ni double layer base heat-resistant Sn-plated Cu—Zn alloy strip, the reflow is performed, so that a satisfactory resistance to whiskers is obtained.

[Patent Document 1] Japanese Patent Application Laid-Open No. 6-196349

[Patent Document 2] Japanese Patent Application Laid-Open No. 2003-293187

[Patent Document 3] Japanese Patent Application Laid-Open No. 2004-68026

However, a very large internal stress is locally applied to an electric contact portion such as the terminal. Therefore, micro whiskers are sometimes generated even in the reflowed Sn-plated strip which has been considered as having the satisfactory resistance to the whiskers. In recent years, owing to the multipolarization of connector or the like, a space between terminals becomes small, and hence even such micro whiskers as not to be heretofore any problem might cause a short-circuit of a circuit. As a result, even for the Cu/Ni double layer base heat-resistant Sn-plating of the Cu—Zn alloy which has been considered to have the satisfactory resistance to whiskers, further improvement of whisker resistance is required.

DISCLOSURE OF THE INVENTION

An object of the present invention is to provide a Cu/Ni double layer base reflowed Sn-plated Cu—Zn alloy strip in which generation of whiskers is suppressed.

The present inventors have intensively investigated an approach to suppressing generation of whiskers in the Cu/Ni double layer base reflowed Sn-plated Cu—Zn alloy strip, and have found that when Zn is concentrated on an Sn-plated surface, the whiskers are suppressed. However, as described above, when Zn is concentrated on the Sn-plated surface, solderability deteriorates. To solve the problem, the present inventors have searched for such a Zn concentrated state that both of whisker suppression and the satisfactory solderability are achieved, and have succeeded in finding this state. Simultaneously, as manufacturing conditions for obtaining this appropriate Zn concentrated state, properties of a Zn—Cu alloy strip surface, a Cu base plating thickness, an Ni base plating thickness, an Sn plating thickness, and heating conditions in a reflow treatment could be clarified.

The present invention has been developed based on this finding, and it is as follows.

(1) A Sn-plated Cu—Zn alloy strip in which generation of whiskers is suppressed, wherein a copper alloy containing 15 to 40 mass % of Zn in terms of an average concentration is used as an alloy strip, the layers of an Sn phase, an Sn—Cu alloy phase and an Ni phase constitute a plating film from the surface to the alloy strip, and the Zn concentration of the surface of the Sn phase is in a range of 0.1 to 5.0 mass %.

(2) The Sn-plated Cu—Zn alloy strip according to (1), wherein a copper base alloy containing 15 to 40 mass% of Zn and a balance of Cu and unavoidable impurities is used as the alloy.

(3) The Sn-plated Cu—Zn alloy strip according to (2), wherein the alloy further contains 0.005 to 10 mass % in total of at least one element selected from the group consisting of Sn, Ag, Pb, Fe, Ni, Mn, Si, Al and Ti.

(4) The Sn-plated Cu—Zn alloy strip according to (1), wherein a copper base alloy containing 15 to 40 mass % of Zn, 8 to 20 masse of Ni, 0 to 0.5 mass % of Mn and a balance of Cu and unavoidable impurities is used as the alloy.

(5) The Sn-plated Cu—Zn alloy strip according to (4), wherein the alloy further contains 0.005 to 10 mass % in total of at least one element selected from the group consisting of Sn, Ag, Pb, Fe, Si, Al and Ti.

(6) A manufacturing method of an Sn-plated strip in which generation of whiskers is suppressed, characterized by successively subjecting a copper alloy containing 15 to 40 mass % of Zn in terms of an average concentration to the following steps:

a. a step of adjusting the Zn concentration at a position of 0.1 μm from the surface of an alloy strip to a range of 10 to 40 mass % by surface polishing;

b. a step of performing Ni plating in a thickness of 0.1 μm or more, and then performing Cu plating in a thickness of 0.1 μm or more (provided that the total of the Ni plating thickness and the Cu plating thickness is in a range of 0.3 to 1.0 μm);

c. a step of performing Sn plating in a thickness of 0.3 to 1.0 μm; and d. a step of performing a reflow treatment for heating time t (seconds) and at a heating temperature T (° C.) represented by the following three equations:

$$5 \leqq t \leqq 23,$$

$$350 \leqq T \leqq 600, \text{ and}$$

$$500 \leqq (T+14t) \leqq 670.$$

It is to be noted that the Sn-plated Cu—Zn based alloy includes a case where the plating is performed before press processing into a component (pre-plating) and a case where the plating is performed after the press processing (post-plating). In both the cases, the effect of the present invention is obtained.

According to the present invention, there can be provided a Cu/Ni double layer base reflowed Sn-plated Cu—Zn alloy strip in which generation of whiskers is suppressed.

BEST MODE FOR CARRYING OUT THE INVENTION

Figure 1:
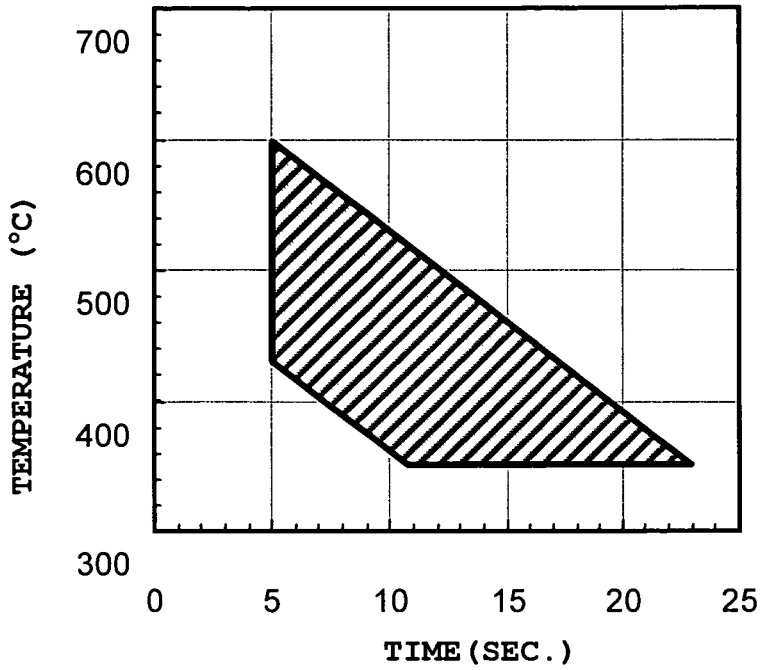
FIG. 1 is a diagram showing reflow treatment conditions (temperature and time) according to the present invention.

The present invention will hereinafter be described in detail.

(1) Composition of the Alloy Strip

In the present invention, a copper alloy containing 15 to 40 mass % of Zn is a target, and the function and effect of the present invention may not be developed with respect to a copper alloy in which Zn concentration is out of this range.

Examples of the copper alloy containing 15 to 40 mass % of Zn include brass. According to JIS-H3100, brass such as C2600, C2680 or C2720 is defined. Examples of an alloy with which the function and effect of the present invention are developed include brass.

Examples of the copper alloy other than brass containing 15 to 40 mass % of Zn include nickel silver. Nickel silver contains Ni in addition to Zn, and also contains a small amount of Mn. According to JIS-H3110 and JIS-H3130, nickel silver such as C7521, C7541 or C7701 is defined. The examples of the alloy with which the function and effect of the present invention are developed include nickel silver.

Furthermore, for a purpose of improving strength, heat resistance, stress relaxing properties and the like of the alloy strip, the copper alloy which does not contain Ni or Mn in the present invention may further contain 0.005 to 10 mass % in total of at least one element selected from the group consisting of Sn, Ag, Pb, Fe, Ni, Mn, Si, Al and Ti. Moreover, the copper alloy containing Ni and Mn in the present invention may similarly contain 0.005 to 10 mass % in total of at least one element selected from the group consisting of Sn, Ag, Pb, Fe, Si, Al and Ti. The effect of the present invention can be obtained in the above concentration range. On the other hand, when the content is less than 0.005 mass %, the effect of the added element is not achieved. When the content exceeds 10 mass %, conductivity and manufacturing properties become lower. The content is preferably in a range of 0.05 to 5 mass %.

(2) Structure of Plating

The basic structure of Sn plating in the present invention is constituted of the layers of an Sn phase, an Sn—Cu alloy phase and an Ni phase from the surface to the Zn—Cu alloy strip in the same manner as in conventional Cu/Ni double layer base reflowed Sn plating. Characteristics of the present invention lie in that Zn is the concentration on the surface of the Sn phase to an appropriate concentration.

When a local stress is applied to the Sn plating layer, whiskers are generated on the plated surface. When Zn is present around the Sn-plated surface, the generation of the whiskers is suppressed. This is supposedly because Zn moves to an area of the Sn plating layer where a stress is locally large and concentrates resulting in the relief of the stress.

The concentration of Zn on the Sn plating layer surface occurs, when Zn included in the Zn—Cu alloy strip diffuses during heating in a reflow treatment. In the case of a Cu/Ni double layer base, when the Zn concentration of the Sn-plated surface is 0.1 mass % or more, an effect of inhibiting generation of whiskers is produced. It is defined in the present invention that "the Zn concentration of the Sn phase surface" is the Zn concentration at a position of 0.01 μm from the Sn-plated surface in a depth direction. The Zn concentration of the Sn-plated surface in the present invention can be analyzed by glow discharge spectrometry (GDS). The above critical Zn concentration of 0.1 mass % is considerably low as compared with a critical Zn concentration of 3 mass % confirmed in the Cu base plating of the copper alloy containing 20 to 40 mass % of Zn (the specification of Japanese Patent Application No. 2004-358897).

The Cu/Ni double layer base reflow Sn plating is frequently used in an environment at a high temperature owing to the satisfactory heat resistance of the plating.

Therefore, in addition to satisfactory solderability immediately after reflow treatment, it is demanded that even when the reflowed plating is held in the environment at a high temperature for a long time, the solderability does not deteriorate (hereinafter referred to as the heat-resistant solderability). When the Zn concentration of the Sn-plated surface exceeds 5.0 mass %, the heat-resistant solderability deteriorates.

In consequence, the Zn concentration of the Sn-plated surface is in a range of 0.1 to 5.0 mass %. The Zn concentration of the Sn-plated surface is more preferably in a range of 0.3 to 3.0 mass % where the whisker suppressing effect and the satisfactory heat-resistant solderability are more stably achieved.

It is to be noted that the effect of the present invention is exerted, when Zn concentration of the Sn phase surface is in the above range. Therefore, there is not any specific restriction on the thicknesses of the Sn phase, the Sn—Cu alloy phase and the Ni phase after reflow treatment.

(3) Manufacturing Method

The above plating structure is obtained by adjusting to appropriate ranges, five factors including the Zn concentration of the plating alloy strip surface, the thickness of the Ni base plating, the thickness of the Cu base plating, the thickness of the Sn plating and reflow conditions.

a. Zn Concentration of Plating Alloy Strip Surface

In the Sn-plated strip in which a Cu—Zn based alloy is a plating alley strip, Zn in the plating alloy strip diffuses to the Sn plating layer during heating treatment.

In a case where the heating is performed on the reflow conditions described later, when the Zn concentration of the plating alloy strip surface is less than 10 mass %, it is difficult to adjust the Zn concentration of the Sn-plated surface to 0.1 masse or more. When the Zn concentration of the alloy strip surface exceeds 40 masse, it is difficult to adjust the Zn concentration of the Sn-plated surface to 5 mass % or less. Therefore, the Zn concentration of the surface of the Cu—Zn alloy used in the plating alloy strip is adjusted to 10 to 40 mass %, preferably 15 to 30 masse. It is defined in the present invention that "the Zn concentration of the alloy strip surface" is the Zn concentration at a position of 0.1 μm from the alloy strip surface. The Zn concentration of the alloy strip surface can be analyzed by a GDS.

After hot-rolling of an ingot manufactured by melting and casting if necessary, cold rolling and annealing are repeated to process the Cu—Zn based alloy as the plating mother material into a strip. It is known that a dezincification phenomenon occurs during the annealing of a Cu—Zn based alloy. The dezincification phenomenon is a phenomenon in which when a Cu—Zn based alloy is heated to a high temperature during an annealing, Zn is oxidized and released in a gas phase, and the Zn concentration of the Cu—Zn based alloy surface decreases. Therefore, to adjust the Zn concentration of the Cu—Zn based alloy surface to the above range, a dezincification layer generated during the annealing needs to be removed. Examples of a removing method include mechanical polishing using a rotary buff and chemical polishing using an etchant.

In the present invention, it is important to adjust a Zn concentration of the Cu—Zn system alloy strip surface immediately before Sn plating to the above range, and there is not any specific restriction on means or step order. For example, the Cu—Zn system alloy used for a connector is frequently provided for Sn plating in a state in which the alloy is well tempered by cold rolling after annealing. In this case, the polishing for removing the dezincification layer may be performed before the cold rolling (immediately after the annealing) or after the cold rolling (immediately before the plating).

b. Ni Base Plating Thickness and Cu Base Plating Thickness

The plating layer after the reflow in the present invention is constituted of the layers of an Sn phase, an Sn—Cu alloy phase and an Ni phase from the surface side. The Ni phase suppresses the diffusion of alloy elements (Cu, Zn and the other element) into the Sn—Cu alloy phase. The Sn—Cu alloy phase suppresses the diffusion of Ni into the Sn phase. Owing to the functions of the Ni phase and the Sn—Cu alloy phase as diffusion barriers, the Cu/Ni double layer base material exhibits satisfactory heat resistance as compared with a Cu base material and an Ni base material.

To obtain a desired heat resistance, the thickness of the Ni plating after electrodeposition is set to 0.1 μm or more. When the Ni plating thickness is less than 0.1 μm, the diffusion of the alloy elements into the Cu—Sn alloy phase cannot be suppressed. Moreover, the Cu plating thickness formed by electrodeposition is set to 0.1 μm or more. When the Cu plating thickness is less than 0.1 μm, a sufficiently thick Sn—Cu alloy phase is not formed, and the diffusion of Ni into Sn cannot be suppressed. It is to be noted that the upper limit of the Ni or Cu plating thickness after the electrodeposition is determined by the total of the Cu plating thickness after the electrodeposition and the Ni plating thickness after the electrodeposition described later.

Next, to adjust the Zn concentration of the Sn-plated surface immediately after reflow treatment to a range of 0.1 to 5.0 mass %, the total (hereinafter referred to as the total thickness) of the thickness of the Cu plating after electrodeposition and the thickness of the Ni plating after electrodeposition is set to 0.3 to 1.0 μm. When the total thickness is less than 0.3 μm and the heating is performed on the reflow conditions described later, Zn of the alloy strip excessively diffuses in the Sn phase, and the Zn concentration of the Sn-plated surface exceeds 5.0 mass %. When the total thickness exceeds 1.0 μm and the heating is performed on the reflow conditions described later, Zn of the alloy strip does not sufficiently diffuse in the Sn phase, and the Zn concentration of the Sn-plated surface becomes less than 0.1 mass %.

More preferably, the Cu plating thickness is 0.2 μm or more, the Ni plating thickness is 0.2 μm or more, and the total thickness is in a range of 0.4 to 0.7 μm. In the range, the desired heat resistance and the desired Zn concentration of the Sn-plated surface are more stably obtained.

c. Sn Plating Thickness

When the Sn plating thickness is less than 0.3 μm and the heating is performed on the reflow conditions described later, the Zn concentration of the Sn-plated surface exceeds 5.0 mass %. When the Sn plating thickness exceeds 1.0 μm and the heating is performed on the reflow conditions described later, the Zn concentration of the Sn-plated surface is below 0.1 mass %. Therefore, the Sn plating thickness is in a range of 0.3 to 1.0 μm. The Sn plating thickness is more preferably in a range of 0.6 to 0.8 μm.

d. Reflow Conditions

The reflow conditions on which the Zn concentration of the Sn-plated surface falls in the range of the present invention are as follows. When heating time is less than five seconds, Zn does not sufficiently diffuses in the Sn plating layer, and the Zn concentration of the Sn-plated surface is below 0.1 masse. When the heating time exceeds 23 seconds, Zn remarkably diffuses, hence the Zn concentration of the Sn-plated surface exceeds 5.0 mass %. Therefore, the heating time in the reflow treatment is in a range of 5 to 23 seconds ($5 \leqq t \leqq 23$, in which t is the heating time in a unit of second). The heating time is preferably in a range of five to 15 seconds.

Moreover, when the heating temperature is less than 350° C., Zn does not sufficiently diffuse from the alloy strip to the Sn plating layer, and the Zn concentration of the Sn-plated surface is below 0.1 mass %. When the heating temperature exceeds 600° C., Zn remarkably diffuses. Therefore, the Zn concentration of the Sn-plated surface exceeds 5.0 mass %. Additionally, the plated alloy strip recrystallizes and softens, so that a mechanical strength necessary for an application such as the connector cannot be obtained. Therefore, the heating temperature in the reflow treatment is in a range of 350 to 600° C. ($350 \leqq T \leqq 600$, in which T is the heating temperature in a unit of ° C.). The heating temperature is preferably in a range of 400 to 550° c.

Furthermore, the diffusion of Zn in the Sn plating layer is determined by a relation between both factors of temperature and time. This relation is represented by the following equation:

$$500 \leqq (T+14t) \leqq 670.$$

When (T+14t) is less than 500, the Zn concentration of the Sn-plated surface becomes less than 0.1 masse, and whiskers are generated. On the other hand, when it exceeds 670, the Zn concentration of the Sn-plated surface exceeds 5.0 masse, and heat-resistant solderability deteriorates. (T+14t) is preferably in a range of 550 to 650.

In FIG. 1 showing the reflow treatment conditions (the temperature and the time) according to the present invention, the reflow treatment conditions are shown in a hatched range. Here, T is heating temperature (° C.), and t is heating time (seconds).

Figure 2:
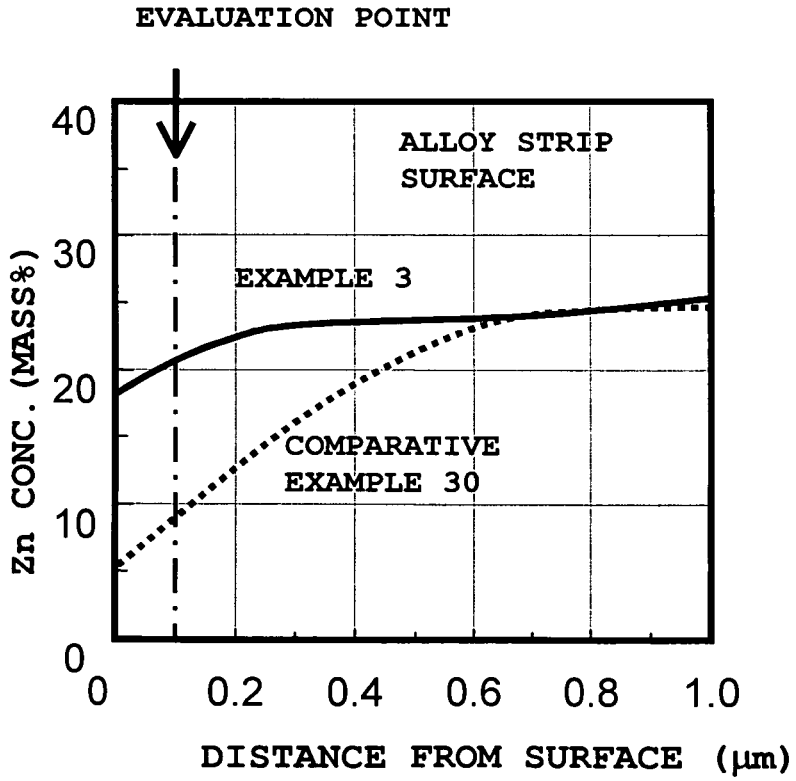
FIG. 2 is a chart showing the Zn concentration of the alloy strip surface in Example 3 and Comparative Example 30.

As for one example of GDS analysis data of the alloy strip surface, FIG. 2 shows a GDS chart of the alloy strip surface used in Example 3 and Comparative Example 30 described later. An evaluation point has a depth of 0.1 μm from the surface. Analysis conditions are as follows.

Pretreatment of a sample: ultrasonic degreasing in acetone
Device: JY5000RF-PSS model manufactured by JOBIN YBON Co.
Current method program: CNBinteel-12aa-0
Mode: Constant electric power=40 W
Air pressure: 775 Pa
Current value: 40 mA (700 V)
Flush time: 20 sec.
Preburn time: 2 sec.
Determination time: analysis time=30 sec., sampling time=0.020 sec./point

EXAMPLES

Cu—Zn based alloys (thickness of 0.2 mm) shown in Table 1 were used as samples. Table 1 shows the average Zn concentration of an alloy strip as the composition of the alloy strip. Moreover, as the Zn concentration of the alloy strip surface (the surface Zn concentration), there is shown the Zn concentration (mass %) at a position of 0.1 μm from the surface in a depth direction, analyzed by glow discharge spectrometry (GDS).

The surface Zn concentration is adjusted by annealing and polishing conditions. Table 2 shows manufacturing conditions of Comparative Example 30, Examples 1, 2, 3 and 23 and Comparative Example 31 of Table 1. After subjecting the Cu—Zn alloy strip having a thickness of 0.25 mm to recrystallization annealing on various conditions, the surface was chemically polished using an aqueous solution of 20 mass % of $H_2SO_4$–1 mass % of $H_2O_2$. Afterward, the strip was cold-rolled to 0.2 mm. In Table 2, "average (a)" is the average Zn concentration of the alloy strip, and "surface (b)" is the Zn concentration at a position of 0.1 μm from the surface of the alloy strip. From Table 2, the following facts are comprehended.

(1) During annealing in a burning gas (weakly oxidizing atmosphere), when a CO concentration is increased and an $O_2$ concentration is decreased, the surface Zn concentration increases. Moreover, when a polished amount is increased, the surface Zn concentration increases.

(2) The surface Zn concentration obtained during the annealing at a low temperature for a long time is higher than the surface Zn concentration obtained during the annealing at a high temperature for a short time.

(3) When the strip is annealed in hydrogen (reducing atmosphere) adjusted to a low dew point, the oxidation of Zn (release into a gas phase) does not occur, so that the surface Zn concentration increases.

The samples of Table 1 were plated in the following steps.

(Step 1) The samples as cathodes were electrolytically degreased in an aqueous alkali solution on the following conditions: current density of 3 A/dm$^2$; a degreasing agent: trademark "PAKUNA P105" manufactured by YUKEN Industry CO., LTD.; a degreasing agent concentration of 40 g/L; temperature: 50° C.; time: 30 seconds; a current density of 3 A/dm$^2$.

(Step 2) The samples were acid-washed by using 10 mass % of an aqueous sulfuric acid solution.

(Step 3) The samples were subjected to Ni base plating on the following conditions:

Plating bath composition: 250 g/L of nickel sulfate, 45 g/L of nickel chloride and 30 g/L of boric acid
Plating bath temperature: 50° C.
Current density: 5 A/dm$^2$
The Ni plating thickness was adjusted in accordance with electrodeposition time.

(Step 4) The samples were subjected to Cu base plating on the following conditions:

Plating bath composition: 200 g/L of copper sulfate, 60 g/L of sulfuric acid
Plating bath temperature: 25° C.
Current density: 5 A/dm$^2$
The Cu plating thickness was adjusted in accordance with electrodeposition time.

(Step 5) The samples were subjected to Sn plating on the following conditions.

Plating bath composition: 41 g/L of tin II oxide (stannous oxide), 268 g/L of phenolsulfonic acid and 5 g/L of surfactant
Plating bath temperature: 50° C.
Current density: 9 A/dm$^2$
The Sn plating thickness was adjusted in accordance with electrodeposition time.

(Step 6) As a reflow treatment, the samples were inserted into a heating furnace of an atmospheric gas replaced with nitrogen (1 vol % or less of oxygen), and they were heated and then water-quenched. The temperature of the heating furnace (reflow temperature) and the insertion time in the heating furnace (reflow time) are shown in Table 1.

Figure 3:
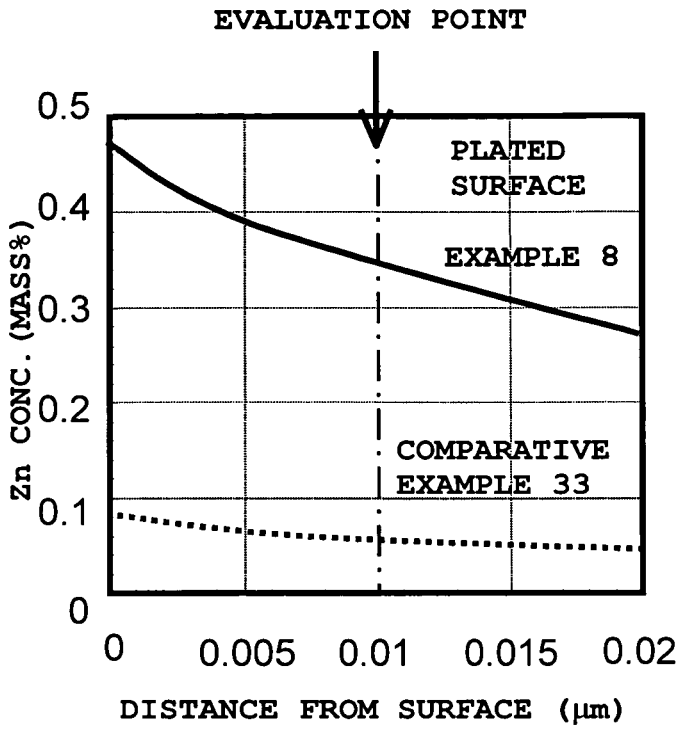
FIG. 3 is a chart showing the Zn concentration of the Sn-plated surface in Example 8 and Comparative Example 33.

Regarding the samples after the reflow treatment, the Zn concentration of the Sn-plated surface was analyzed using GDS on the above conditions. As one example of the GDS analysis data of the Sn-plated surface, FIG. 3 shows a chart of Example 8 and Comparative Example 33. An evaluation point has a depth of 0.01 μm from the plated surface, and the Zn concentration at the position is read from the chart and shown in Table 1.

Regarding the samples, whisker length and solderability were evaluated by the following method.

(1) Whisker Length

Each of the samples was left to stand at room temperature for seven days while a spherical indenter (made of stainless steel) having a diameter of 0.7 mm and having a load of 150 g was brought into contact with the surface of the sample, and whiskers were generated in an indenter contact portion on the plated surface. The generated whiskers were observed with an electron microscope. A case where the length of the longest grown whisker of each sample was 10 μm or less was evaluated as a circle (good), and a case where the length exceeded 10 μm was evaluated as a cross (poor).

(2) Heat-Resistant Solderability

Regarding the sample held at a high temperature, the wettability to lead-free solder was evaluated. Specifically, after degreasing the sample with acetone, the sample was heated at 145° C. in the atmosphere for 500 hours. The heated sample was coated with 25 mass % of rosin-75 mass % of ethanol as a flux, and then immersed into a solder bath of Sn-3.0 mass % of Ag-0.5 mass % of Cu at 260° C. for ten seconds. The surface area of an immersed portion was set to 10 mm×10 mm. After drawing up the sample from the solder bath, the area ratio of the portion of the sample to which the solder had been attached was measured. A case where the solder attached surface ratio was 80% or more was evaluated as a circle (good), and a case where the attached area ratio was less than 80% was evaluated as a cross (poor).

The evaluation results of the Examples and the comparative examples are shown in Table 1.

TABLE 1

| | Composition of alloy strip (mass %) | | Zn conc. of alloy strip Surface | Plating thickness(μm) | | | | Reflow conditions | | | Zn conc. of plated Sn | | Heat-resistant |
|---|---|---|---|---|---|---|---|---|---|---|---|---|---|
| | Zn | Others | (mass %) | Ni | Cu | Ni + Cu | Sn | Temp. T (° C.) | Time t (sec.) | T + 14t | surface (mass %) | Whisker | solderability |
| Examples | | | | | | | | | | | | | |
| 1 | 24.5 | — | 10.6 | 0.25 | 0.25 | 0.50 | 0.60 | 400 | 10 | 540 | 0.20 | ○ | ○ |
| 2 | 23.3 | — | 15.6 | 0.25 | 0.25 | 0.50 | 0.60 | 400 | 10 | 540 | 1.17 | ○ | ○ |
| 3 | 24.6 | — | 20.6 | 0.25 | 0.25 | 0.50 | 0.60 | 400 | 10 | 540 | 2.78 | ○ | ○ |
| 4 | 30.7 | — | 25.4 | 0.15 | 0.17 | 0.32 | 0.80 | 550 | 6 | 634 | 3.24 | ○ | ○ |
| 5 | 30.3 | — | 26.7 | 0.20 | 0.20 | 0.40 | 0.80 | 550 | 6 | 634 | 1.36 | ○ | ○ |
| 6 | 30.6 | — | 24.0 | 0.20 | 0.30 | 0.50 | 0.80 | 550 | 6 | 634 | 1.11 | ○ | ○ |
| 7 | 30.5 | — | 25.0 | 0.30 | 0.30 | 0.60 | 0.80 | 550 | 6 | 634 | 0.84 | ○ | ○ |
| 8 | 30.2 | — | 25.7 | 0.40 | 0.30 | 0.70 | 0.80 | 550 | 6 | 634 | 0.35 | ○ | ○ |
| 9 | 30.6 | — | 24.6 | 0.50 | 0.40 | 0.90 | 0.80 | 550 | 6 | 634 | 0.13 | ○ | ○ |
| 10 | 35.6 | — | 28.3 | 0.30 | 0.30 | 0.60 | 0.35 | 450 | 12 | 618 | 4.12 | ○ | ○ |
| 11 | 35.1 | — | 31.2 | 0.30 | 0.30 | 0.60 | 0.45 | 450 | 12 | 618 | 2.95 | ○ | ○ |
| 12 | 35.2 | — | 30.6 | 0.30 | 0.30 | 0.60 | 0.55 | 450 | 12 | 618 | 1.77 | ○ | ○ |
| 13 | 35.6 | — | 30.0 | 0.30 | 0.30 | 0.60 | 0.65 | 450 | 12 | 618 | 1.26 | ○ | ○ |
| 14 | 35.4 | — | 28.6 | 0.30 | 0.30 | 0.60 | 0.75 | 450 | 12 | 618 | 0.90 | ○ | ○ |
| 15 | 35.3 | — | 31.2 | 0.30 | 0.30 | 0.60 | 0.85 | 450 | 12 | 618 | 0.38 | ○ | ○ |
| 16 | 35.2 | — | 29.0 | 0.30 | 0.30 | 0.60 | 0.95 | 450 | 12 | 618 | 0.17 | ○ | ○ |
| 17 | 30.6 | — | 20.2 | 0.30 | 0.25 | 0.55 | 0.70 | 400 | 18 | 652 | 1.15 | ○ | ○ |
| 18 | 30.1 | — | 19.5 | 0.30 | 0.25 | 0.55 | 0.70 | 360 | 20 | 640 | 0.86 | ○ | ○ |
| 19 | 29.5 | — | 20.0 | 0.30 | 0.25 | 0.55 | 0.70 | 580 | 5 | 650 | 0.24 | ○ | ○ |
| 20 | 30.0 | — | 21.1 | 0.30 | 0.25 | 0.55 | 0.70 | 450 | 13 | 632 | 0.71 | ○ | ○ |
| 21 | 29.4 | — | 19.6 | 0.30 | 0.25 | 0.55 | 0.70 | 420 | 8 | 532 | 0.18 | ○ | ○ |
| 22 | 29.7 | — | 20.6 | 0.30 | 0.25 | 0.55 | 0.70 | 370 | 14 | 566 | 0.16 | ○ | ○ |
| 23 | 39.7 | — | 38.0 | 0.35 | 0.30 | 0.65 | 0.65 | 390 | 18 | 642 | 4.62 | ○ | ○ |
| 24 | 18.2 | 17.3Ni, 0.22Mn | 16.5 | 0.25 | 0.25 | 0.50 | 0.70 | 570 | 6 | 654 | 0.87 | ○ | ○ |
| 25 | 26.3 | 17.0Ni, 0.05Mn | 22.1 | 0.30 | 0.30 | 0.60 | 0.75 | 550 | 8 | 662 | 1.16 | ○ | ○ |
| 26 | 21.2 | 1.1Ni, 3.2Al | 15.4 | 0.30 | 0.25 | 0.55 | 0.75 | 520 | 10 | 660 | 1.31 | ○ | ○ |
| 27 | 25.4 | 0.83Sn | 22.3 | 0.35 | 0.30 | 0.65 | 0.80 | 380 | 15 | 590 | 0.36 | ○ | ○ |
| 28 | 20.6 | 0.16Ni, 0.40Si, 0.31Sn | 14.2 | 0.30 | 0.30 | 0.60 | 0.80 | 420 | 15 | 630 | 1.65 | ○ | ○ |
| 29 | 30.5 | 0.05Ag | 11.8 | 0.25 | 0.25 | 0.50 | 0.85 | 440 | 16 | 664 | 0.32 | ○ | ○ |
| Comparative Examples | | | | | | | | | | | | | |
| 30 | 25.3 | — | 9.1 | 0.25 | 0.25 | 0.50 | 0.60 | 400 | 10 | 540 | 0.04 | x | ○ |
| 31 | 39.1 | — | 40.6 | 0.35 | 0.30 | 0.65 | 0.65 | 390 | 18 | 642 | 5.14 | ○ | x |
| 32 | 30.5 | — | 26.3 | 0.10 | 0.15 | 0.25 | 0.80 | 550 | 6 | 634 | 5.64 | ○ | x |
| 33 | 30.4 | — | 25.4 | 0.50 | 0.55 | 1.05 | 0.80 | 550 | 6 | 634 | 0.06 | x | ○ |
| 34 | 30.1 | — | 24.5 | 0.05 | 0.30 | 0.35 | 0.80 | 550 | 6 | 634 | 2.05 | ○ | x |
| 35 | 30.6 | — | 25.0 | 0.30 | 0.05 | 0.35 | 0.80 | 550 | 6 | 634 | 1.94 | ○ | x |
| 36 | 35.3 | — | 29.6 | 0.30 | 0.30 | 0.60 | 0.25 | 450 | 12 | 618 | 5.34 | ○ | x |
| 37 | 35.7 | — | 30.6 | 0.30 | 0.30 | 0.60 | 1.05 | 450 | 12 | 618 | 0.04 | x | ○ |
| 38 | 30.6 | — | 20.9 | 0.30 | 0.25 | 0.55 | 0.70 | 500 | 15 | 710 | 5.06 | ○ | x |
| 39 | 29.7 | — | 20.7 | 0.30 | 0.25 | 0.55 | 0.70 | 360 | 25 | 710 | 5.31 | ○ | x |
| 40 | 29.5 | — | 20.2 | 0.30 | 0.25 | 0.55 | 0.70 | 620 | 6 | 704 | 6.02 | ○ | x |
| 41 | 29.8 | — | 20.6 | 0.30 | 0.25 | 0.55 | 0.70 | 360 | 8 | 472 | 0.05 | x | ○ |
| 42 | 29.7 | — | 19.7 | 0.30 | 0.25 | 0.55 | 0.70 | 500 | 4 | 556 | 0.09 | x | ○ |
| 43 | 30.3 | — | 19.3 | 0.30 | 0.25 | 0.55 | 0.70 | 340 | 14 | 536 | 0.09 | x | ○ |

"—" in the table indicates additive-free.

TABLE 2

| | Zn conc. of alloy strip (mass %) | | | | Polishing |
|---|---|---|---|---|---|
| | Average(a) | Surface(b) | b/a | Annealing conditions | depth |
| Comparative Example 30 | 25.3 | 9.1 | 0.36 | Burning gas (1%CO—0.05%$O_2$), 700° C., 30 sec. | 0.5 μm |
| Example 1 | 24.5 | 10.6 | 0.43 | Burning gas (1%CO—0.05%$O_2$), 700° C., 30 sec. | 1.0 μm |

TABLE 2-continued

| | Zn conc. of alloy strip (mass %) | | | | Polishing |
|---|---|---|---|---|---|
| | Average(a) | Surface(b) | b/a | Annealing conditions | depth |
| Example 2 | 23.3 | 15.6 | 0.67 | Burning gas (1%CO—0.05%$O_2$), 450° C., 30 min. | 1.0 μm |
| Example 3 | 24.6 | 20.6 | 0.84 | Burning gas (5%CO—0.005%$O_2$), 700° C., 30 min. | 1.0 μm |
| Example 23 | 39.7 | 38.0 | 0.96 | Burning gas (5%CO—0.005%$O_2$), 450° C., 30 sec. | 1.0 μm |
| Comparative Example 31 | 39.1 | 40.6 | 1.04 | Hydrogen (dew point: −40° C.), 400° C., 120 min. | 0.5 μm |

The burning gas composition is indicated in vol %.

In each of Examples 1 to 29 according to the present invention, the Zn concentrations of the Sn-plated surface fell in the range of the present invention. Therefore, the whisker lengths were 10 μm or less, and satisfactory heat-resistant solderability was exhibited with respect to the lead-free solder.

In Comparative Example 30, the Zn concentration of the alloy strip surface was below 10 masse. Therefore, as compared with Examples 1 to 3 in which the alloy strip compositions and the manufacturing conditions were similar, the Zn concentration of the Sn-plated surface decreased below 0.1 mass %, and whiskers having lengths in excess of 10 μm were generated. Moreover, in Comparative Example 31, the Zn concentration of the alloy strip surface exceeded 40 mass %. Therefore, as compared with Example 23 in which the alloy strip composition and the manufacturing conditions were similar, the Zn concentration of the Sn-plated surface exceeded 5.0 mass %, and the heat-resistant solderability deteriorated.

In Examples 4 to 9 and Comparative Examples 32 to 35, the alloy strip having a similar composition was used, the Ni and Cu base plating thicknesses were changed, and the other manufacturing conditions were the same. When the total of the Ni and Cu plating thicknesses increased, the Zn concentration of the Sn-plated surface tended to decrease. In Comparative Example 32 in which the total of the Ni and Cu plating thicknesses was below 0.3 μm, the Zn concentration of the Sn-plated surface exceeded 5.0 masse, and the heat-resistant solderability deteriorated. Moreover, in Comparative Example 33 in which the total thickness exceeded 1.0 μm, the Zn concentration of the Sn-plated surface was less than 0.1 masse, and the whiskers having lengths in excess of 10 μm were generated. In Comparative Examples 34 and 35, the Ni or Cu plating thickness was below 0.1 μm. Therefore, a satisfactory heat resistance which is a characteristic feature of Cu/Ni double layer base reflow Sn plating was lost, and the heat-resistant solderability deteriorated. That is, in Comparative Example 34, since the Ni plating thickness was 0.05 μm, the layer of an Ni phase was not substantially formed, the layer constituting the Sn-plated strip of the present invention and having an effect of inhibiting the diffusion of the alloy strip constituents in an Sn—Cu alloy phase. Moreover, in Comparative Example 35, since the Cu plating thickness was 0.05 μm, the layer of an Sn—Cu alloy phase was not substantially formed, the layer constituting the Sn-plated strip of the present invention and having an effect of inhibiting the diffusion of Ni in Sn.

In Examples 10 to 16 and Comparative Examples 36 and 37, the alloy strip having a similar composition was used, while the Sn plating thickness was changed, and the other manufacturing conditions were the same. When the Sn plating thickness increased, the Zn concentration of the Sn-plated surface tended to decrease. In Comparative Example 36 in which the Sn plating thickness was below 0.3 μm, the Zn concentration of the Sn-plated surface exceeded 5.0 mass %, and the heat-resistant solderability deteriorated. Moreover, in Comparative Example 37 in which the Sn plating thickness exceeded 1.0 μm, the Zn concentration of the Sn-plated surface was less than 0.1 mass %, and whiskers having lengths in excess of 10 μm were generated.

In Examples 17 to 22 and Comparative Examples 38 to 43, the alloy strip having a similar composition was used, while the reflow conditions were changed, and the other manufacturing conditions were the same. In Comparative Examples 38 to 40 in which (T+14t) exceeded 670, the Zn concentration of the Sn-plated surface exceeded 5.0 mass %, and the heat-resistant solderability deteriorated. In Comparative Example 41 in which (T+14t) was below 500, the Zn concentration of the Sn-plated surface was less than 0.1 mass %, and the whiskers having lengths in excess of 10 μm were generated. In Comparative Example 42 in which the reflow time was less than five seconds and in Comparative Example 43 in which the reflow temperature was less than 350° C., the Zn concentration of the Sn-plated surface was less than 0.1 mass %, and the whiskers having lengths in excess of 10 μm were generated.

The invention claimed is:

1. A Sn-plated Cu-Zn alloy strip in which generation of whiskers is suppressed, wherein a copper alloy containing 15 to 40 mass % of Zn in terms of an average concentration is used as an alloy strip, layers of an Sn phase, an Sn—Cu alloy phase and an Ni phase constitute a plating film in that order from an outer surface of the plating film to the alloy strip, and the Zn concentration of the outer surface of the Sn phase is in a range of 0.1 to 5.0 mass % and wherein the layers are formed by:

Ni plating in a thickness of 0.1 μm or more, and then performing Cu plating in a thickness of 0.1 μm or more (provided that the total of the Ni plating thickness and the Cu slating thickness is in a range of 0.3 to 1.0 μm);

Sn plating in a thickness of 0.3 to 1.0 μm; and a reflow treatment for heating time t (seconds) and at a heating temperature T (°C.) represented by the following three equations:

$$5 \leqq t \leqq 23,$$

$$350 \leqq T \leqq 600, \text{ and}$$

$$500 \leqq (T+14t) \leqq 670.$$

2. The Sn-plated Cu—Zn alloy strip according to claim 1, wherein a copper base alloy containing 15 to 40 mass % of Zn and a balance of Cu and unavoidable impurities is used as said copper alloy.

3. The Sn-plated Cu—Zn alloy strip according to claim 2, wherein said copper alloy further contains 0.005 to 10 mass % in total of at least one element selected from the group consisting of Sn, Ag, Pb, Fe, Ni, Mn, Si, Al and Ti.

4. The Sn-plated Cu—Zn alloy strip according to claim 1, wherein a copper base alloy containing 15 to 40 mass % of Zn, 8 to 20 mass % of Ni, 0 to 0.5 mass % of Mn and a balance of Cu and unavoidable impurities is used as said copper alloy.

5. The Sn-plated Cu—Zn alloy strip according to claim 4, wherein said copper alloy further contains 0.005 to 10 mass % in total of at least one element selected from the group consisting of Sn, Ag, Pb, Fe, Si, Al and Ti.

6. A manufacturing method of an Sn-plated strip in which generation of whiskers is suppressed, comprising successively subjecting a copper alloy containing 15 to 40 mass % of Zn in terms of an average concentration to the following steps:

a. a step of adjusting the Zn concentration at a position of 0.1 82 m from the surface of an alloy strip to a range of 10 to 40 mass % by surface polishing;

b. a step of performing Ni plating in a thickness of 0.1 μm or more, and then performing Cu plating in a thickness of 0.1 μm or more (provided that the total of the Ni plating thickness and the Cu plating thickness is in a range of 0.3 to 1.0 μm);

c. a step of performing Sn plating in a thickness of 0.3 to 1.0 μm; and d. a step of performing a reflow treatment for heating time t (seconds) and at a heating temperature T (°C.) represented by the following three equations:

$$5 \leqq t \leqq 23,$$

$$350 \leqq T \leqq 600, \text{ and}$$

$$500 \leqq (T+14t) \leqq 670.$$

wherein the Zn concentration of the surface of the Sn phase after step d. is in a range of 0.1 to 5.0 mass %.

* * * * *

UNITED STATES PATENT AND TRADEMARK OFFICE

CERTIFICATE OF CORRECTION

PATENT NO. : 8,524,376 B2
APPLICATION NO. : 12/226631
DATED : September 3, 2013
INVENTOR(S) : Hatano It is certified that error appears in the above-identified patent and that said Letters Patent is hereby corrected as shown below:

In the Claims

Column 12, line 53, “slating” should read “plating”

Column 13, line 19, “82 m” should read “μm”

Signed and Sealed this
Eighteenth Day of February, 2014

Michelle K. Lee

Michelle K. Lee
*Deputy Director of the United States Patent and Trademark Office*